US007036807B1

(12) United States Patent
Gasparyan et al.

(10) Patent No.: US 7,036,807 B1
(45) Date of Patent: May 2, 2006

(54) QUICK RELEASE VISE

(75) Inventors: Karen Gasparyan, Yerevan (AM); Patvakan Hakhinyan, Yerevan (AM)

(73) Assignee: Industrial Technologies Company, L.L.C., Yerevan (AM)

( * ) Notice: Subject to any disclaimer, the term of this patent is extended or adjusted under 35 U.S.C. 154(b) by 0 days.

(21) Appl. No.: 11/103,990

(22) Filed: Apr. 12, 2005

(51) Int. Cl.
*B25B 1/02* (2006.01)

(52) U.S. Cl. ..... 269/181; 269/43

(58) Field of Classification Search ..... 269/181, 269/43, 41, 178–179
See application file for complete search history.

(56) References Cited

U.S. PATENT DOCUMENTS 389,199 A * 9/1888 Cheney ..... 269/181
2,269,381 A * 1/1942 Robertson ..... 269/181
4,923,185 A * 5/1990 Fan ..... 269/181
4,971,301 A 11/1990 Yang
5,683,077 A 11/1997 Fink et al.
6,092,797 A * 7/2000 You ..... 269/181
6,135,435 A 10/2000 Schmitz
6,595,508 B1 7/2003 Duncan
6,619,644 B1 9/2003 Liou
6,783,123 B1 8/2004 Guimont et al.

* cited by examiner

*Primary Examiner*—Lee D. Wilson
(74) *Attorney, Agent, or Firm*—Patterson & Sheridan LLP

(57) ABSTRACT

A method and apparatus for clamping a work piece is disclosed. The apparatus generally includes a stationary jaw with a first clamping surface and a moveable jaw with a second clamping surface connected and operated by a spindle. The spindle moves the stationary jaw and moveable jaw toward each other when rotated in one direction. The spindle disengages the stationary jaw when rotated in the opposite direction, thus allowing for rapid adjustment of the apparatus.

19 Claims, 7 Drawing Sheets

QUICK RELEASE VISE

BACKGROUND OF THE INVENTION

1. Field of the Invention

Embodiments of the present invention generally relate to a hand tool and more particularly to a vise. More particularly still, embodiments of the invention relate to a table top mounted vise with improved performance and utility.

2. Description of the Related Art

Vises are used in order to temporarily hold one or more objects so that work can be performed on them. Traditional table top mounted vises have existed for years. A typical vise is composed of a stationary jaw with a base that can be mounted to a surface. There is a moveable jaw and a guide rod(s) that allows the moveable jaw to move smoothly toward and away from the stationary jaw. Each jaw has a clamping surface for holding a work piece. Further, the vise has a screw and lever system which operates the moveable jaw. The screw typically has a relatively fine pitched thread which provides a large mechanical advantage such that a relatively small amount of torque applied to the lever produces a large clamping force between the jaws. The screw moves the moveable jaw whereby the fine pitch required for the large mechanical advantage causes the jaw to move a very small distance with each turn. Thus, adjusting the jaws to different opening sizes for clamping of relatively thin and subsequently relatively thick items (or vice versa) requires numerous turns of the lever attached to the screw.

Recent developments in vises have allowed for a quicker adjustment of the vise. The vise designs have generated solutions that allow the fine pitched thread mechanism to be disengaged while allowing rough adjustments of the vise head. Where the traditional vise had a female thread integral to the stationary jaw that engaged with the screw, these new vises have a female thread part separate from the stationary jaw. The separate part is called a semi-thread because it engages with less than 180° of the screw. The semi-thread rides in a track system in the stationary head such that a mechanism can disengage the semi-thread from the screw as desired. With the semi-thread disengaged, a user can slide the moveable jaw to the approximate opening size required for application at hand. A separate lever on the moveable jaw turns a bar or shaft that subsequently disengages the semi-thread from the male thread. The semi-thread is typically spring loaded into engagement with the male thread. With the semi-thread disengaged the jaw opening can be adjusted to the desired size. This system is a vast improvement over previous vises, increasing the efficiency of use.

However, there are several problems with the prior art. The prior art requires two levers to operate. One lever is required to turn the bar and subsequently disengage the semi-thread. While holding this lever in position to keep the semi-thread out of engagement, the jaw opening can be adjusted to the appropriate size by pulling or pushing on the moveable jaw. To apply large clamping force the user must let go of this first lever and grab the second lever that turns the screw to apply a significant clamping force.

Therefore, a need exists for an improved apparatus and method of vise clamping that would allow a user to quickly adjust the opening size of the jaws and apply clamping force to the jaw through the use of one lever.

SUMMARY OF THE INVENTION

The present invention generally relates to a method and apparatus for clamping a work piece. The apparatus generally includes a stationary jaw with a first clamping surface and a moveable jaw with a second clamping surface connected and operated by a spindle. The spindle moves the stationary jaw and moveable jaw toward each other when rotated in one direction. The spindle disengages the stationary jaw when rotated in the opposite direction, thus allowing for rapid adjustment of the apparatus.

According to one aspect of the invention, a clamping apparatus, includes a fixed jaw having a first clamping surface, a moveable jaw having a second clamping surface, and a spindle attached to both the fixed jaw and the moveable jaw for providing movement of the moveable jaw relative to the fixed jaw. The spindle is rotatable in a first direction to move the moveable jaw toward the fixed jaw and is rotatable in a second direction to disengage the fixed jaw from the spindle allowing rough adjustment of the moveable jaw. A lever operates the spindle. According to another aspect of the invention, a clamping apparatus includes a base for attaching the apparatus to a surface, a fixed jaw having a first clamping surface, a moveable jaw having a second clamping surface, a spindle attached to the moveable jaw, the spindle having a cam which operates a semi-nut which engages a threaded portion of the spindle, wherein the semi-nut is attached to the fixed jaw, and one lever which operates the spindle.

According to another aspect of the invention, a method for clamping a work piece, includes rotating a spindle in a first direction, the spindle coupled to a moveable jaw and a fixed jaw, wherein rotation in the first direction causes the moveable jaw to move toward the fixed jaw, clamping a work piece between the moveable jaw and the fixed jaw, rotating the spindle in a second direction to disengage the spindle from the fixed jaw, adjusting the moveable jaw to a desired location while the spindle is disengaged from the fixed jaw, and rotating the spindle in the first direction in order to reengage the spindle with the fixed jaw.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
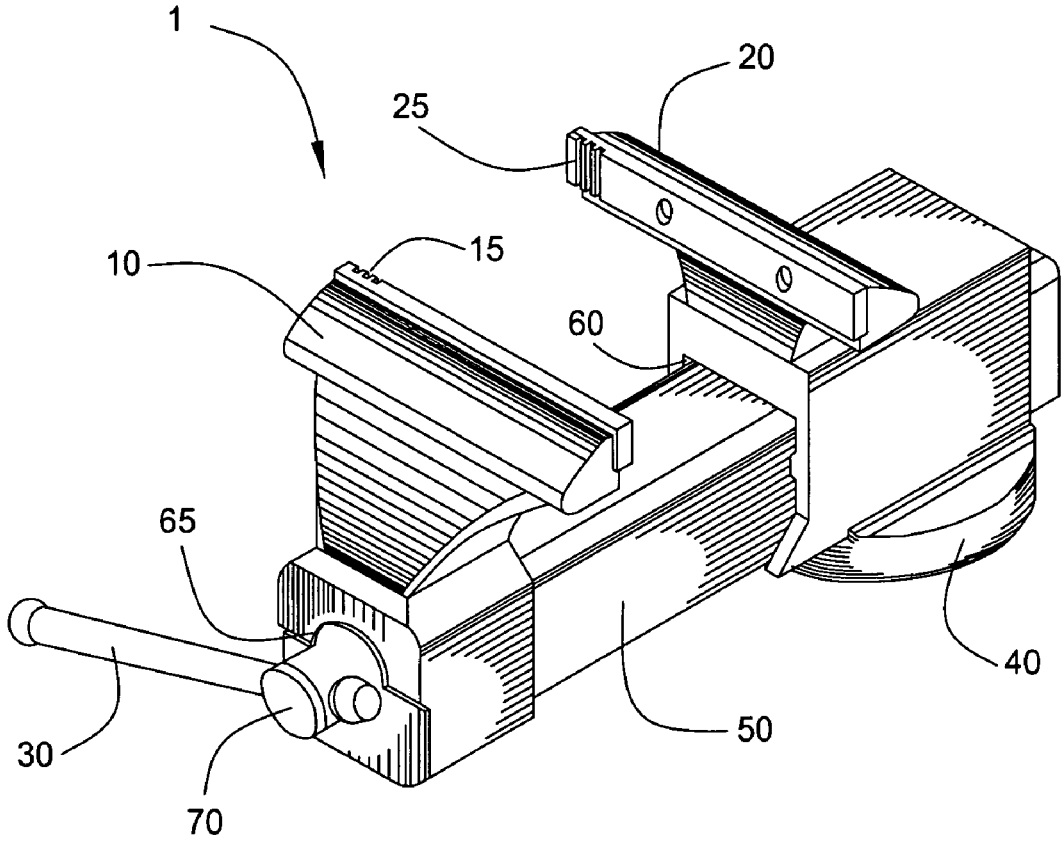
FIG. 1 is a perspective view of the vise in accordance with embodiments of the invention.

FIG. 1 illustrates a perspective view of a vise 1 which is configured to incorporate embodiments of the present invention. The vise 1 includes a moveable jaw 10 which includes a clamping surface 15. The moveable jaw 10 is attached to a channel 50 which is guided through an opening 60 of the housing of a fixed jaw 20. The fixed jaw 20 is attached to a base 40 for mounting the vise 1 to a surface. The fixed jaw 20 includes a clamping surface 25. A spindle 70 is attached to both the moveable jaw 10 and the fixed jaw 20 and projects from the moveable jaw 10 at opening 65. The spindle 70 is attached to a lever 30. The lever 30 moves the moveable jaw 10 toward the fixed jaw 20 when rotated in one direction. The lever 30 releases the fixed jaw 20 from the spindle 70 when rotated in the opposite direction, thus allowing free movement of the moveable jaw 10 (described further below).

Figure 2:
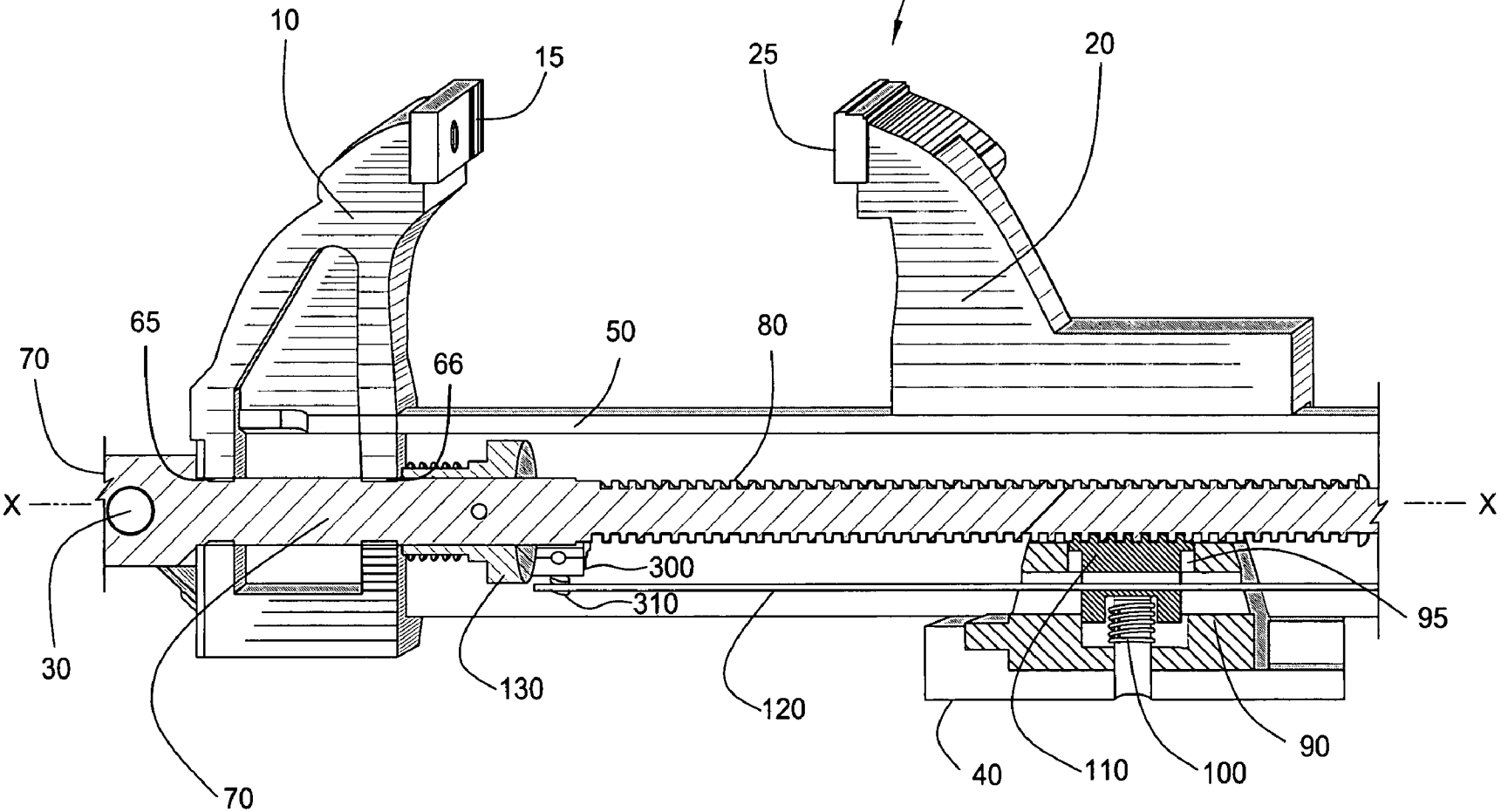
FIG. 2 is a cross sectional view of the vise.

FIG. 2 shows a schematic cross sectional view of the vise 1. The figure depicts the spindle 70 going through the moveable jaw 10 and mechanically engaging the fixed jaw 20 as described below. The spindle 70 attaches to the moveable jaw 10 at opening 65 such that the spindle 70 is free to rotate about axis X—X, but not allowed to move in any other direction. The spindle 70 leaves the moveable jaw 10 through opening 66 and is now inside the channel 50. Near opening 66 the spindle 70 is immovably attached to a cam 130. The cam 130 operates semi-lever 300 which moves a sheet bar 120. The sheet bar 120 moves semi-nut 110 into or out of engagement with a threaded potion 80 of the spindle 70.

The semi-nut 110 rests in aperture 95 of base insert 90 such that the semi-nut 110 moves only toward and away from the spindle 70. At the opposite end of the semi-nut from the spindle 70, a spring 100 attaches to the semi-nut 110. The spring 100 forces the semi-nut 110 into engagement with the threaded portion 80 of the spindle 70. The base insert 90 is immovably attached to the base 40 of the vise 1. As the spindle 70 rotates with the semi-nut 110 engaged, the threaded portion 80 moves the moveable jaw 10 toward or away from the fixed jaw 20.

Figure 3:
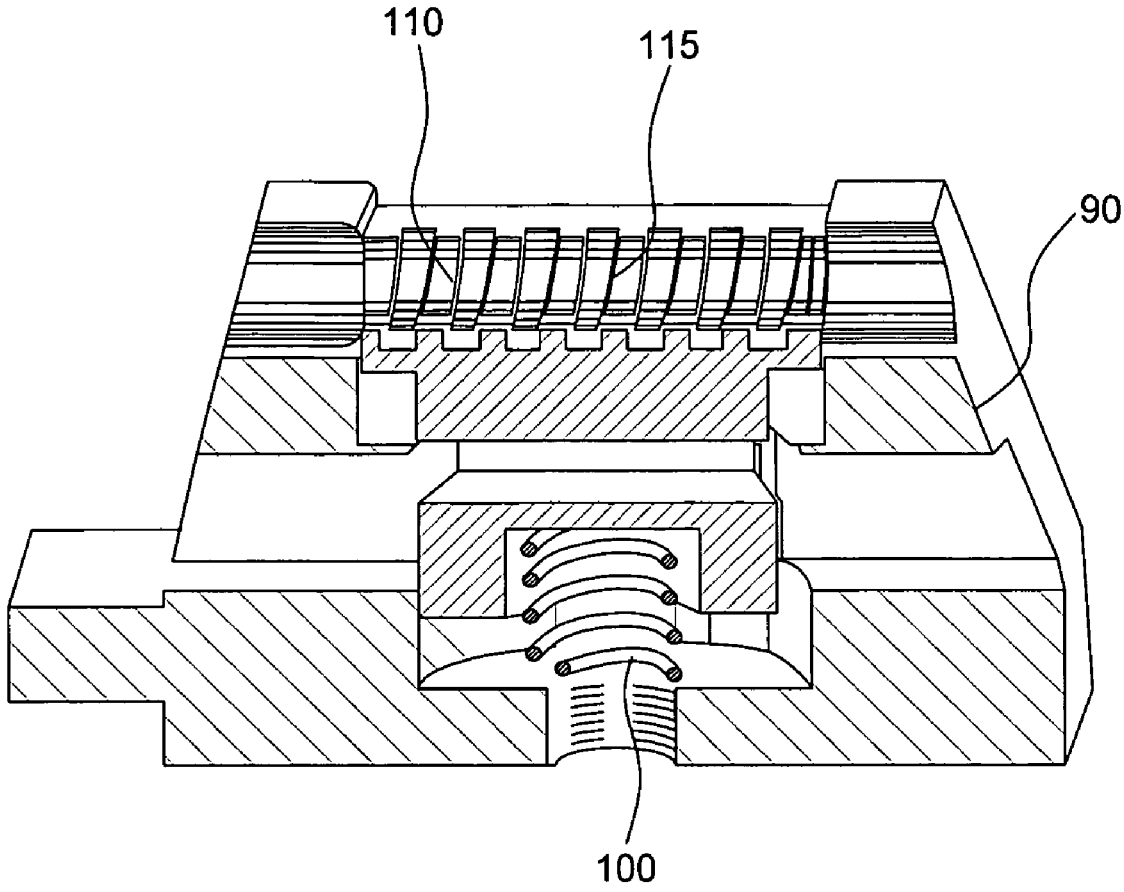
FIG. 3 is a cross sectional view of a base insert and semi-nut.

FIG. 3 depicts a cross sectional view of the base insert 90. The figure depicts a more detailed view of the surface of the semi-nut 110 which engages the threaded portion 80 of the spindle 70. The semi-nut 110 contains threaded grooves 115 which engage with the threaded portion 80 of the spindle 70 in order to move the moveable jaw 10. The base inset 90 and the semi-nut 110 are curved at the top to correspond with the spindle 70.

Figure 4:
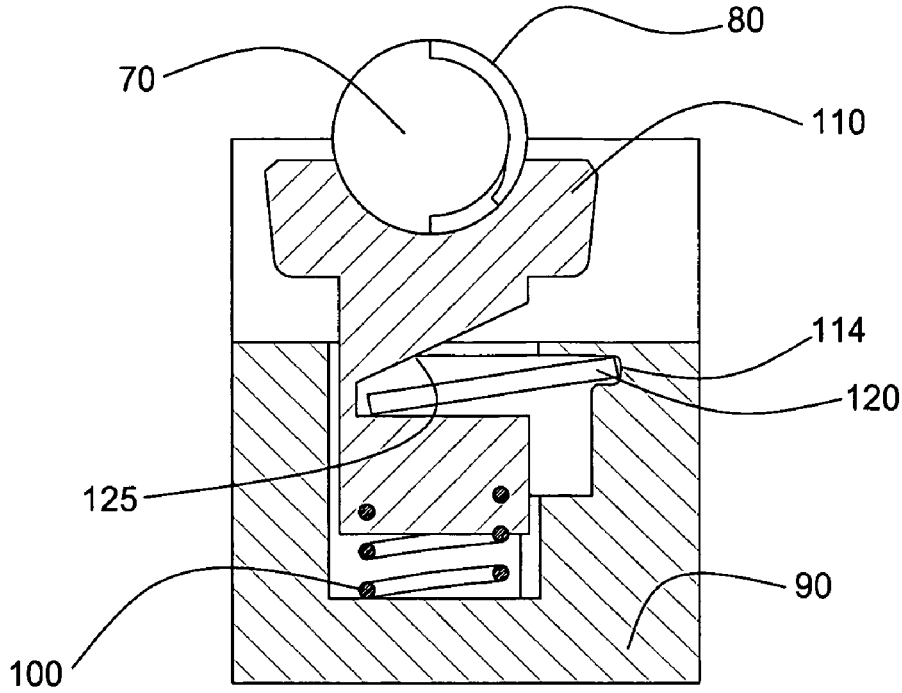
FIG. 4 is a cross sectional end view of the base insert and semi-nut.
Figure 5:
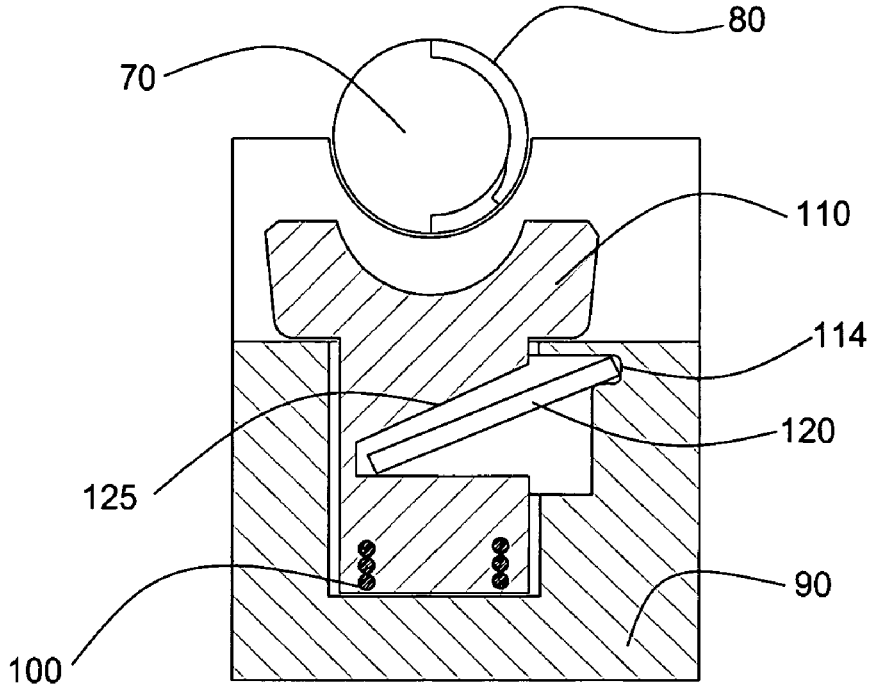
FIG. 5 is a cross sectional end view of the base insert and semi-nut.

FIGS. 4 and 5 depict a cross sectional side view of the base insert 90. The figures show a groove 125 in the semi-nut 110, which is adapted to receive the sheet bar 120. FIG. 4 shows the semi-nut 110 engaged with the spindle 70. With the semi-nut 110 engaged with the spindle, sheet bar 120 rests in a recess 114 in the base insert 90 and does not exert force on the semi-nut 110. As the sheet bar 120 moves, it pushes the semi-nut 110 down causing the spring 100 to compress, as shown in FIG. 5. As the spring 100 compresses, the semi-nut 110 disengages the threaded portion 80 of the spindle 70. With the semi-nut 110 disengaged, the moveable jaw 10 is free to move toward or away from the fixed jaw 20.

Figure 6:
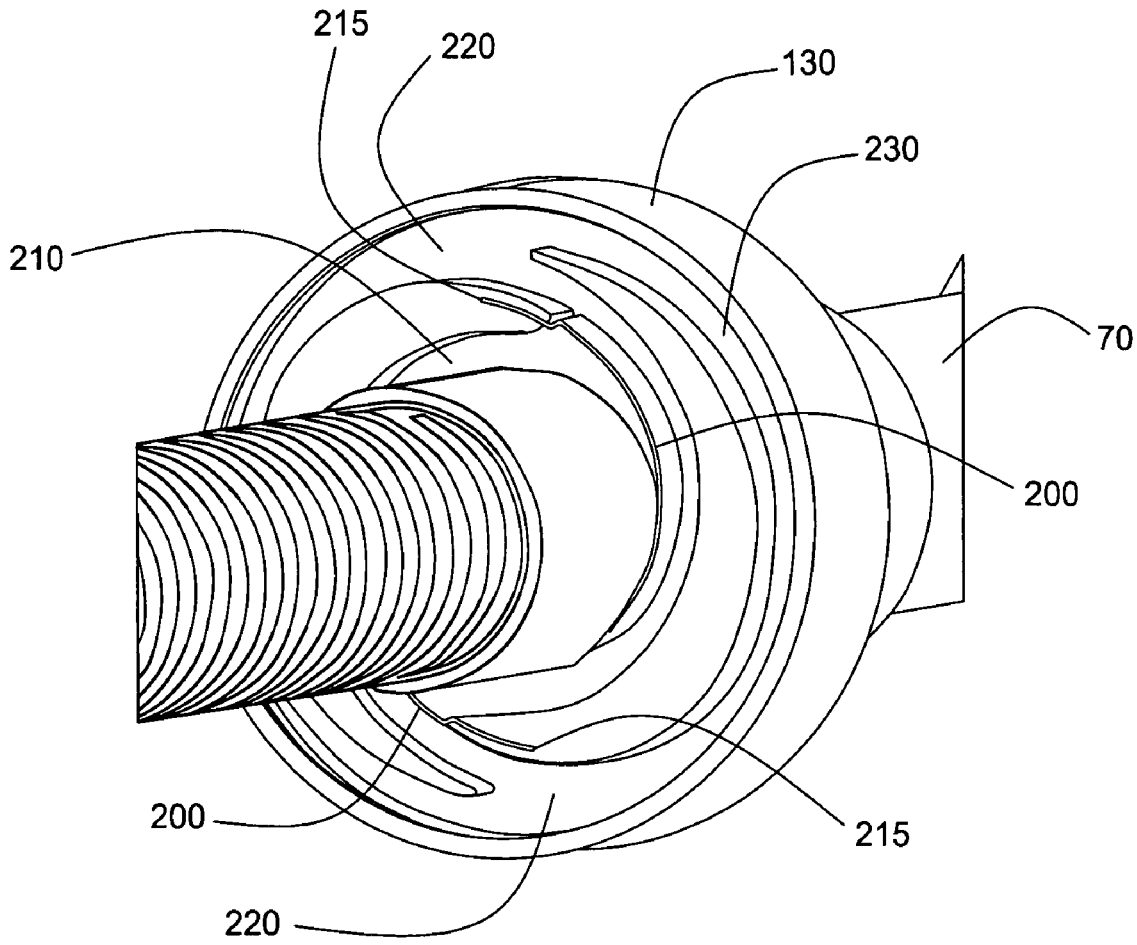
FIG. 6 is a perspective view of a cam and spindle.

FIG. 6 is a perspective view of the cam 130. The cam 130 is a stepped cylindrical part with a central hole through which spindle 70 projects. The cam 130 includes a series of shaped channels 210, 220 and 230 on the face of cam 130. The cam 130 further includes one or more sheet springs 200. One end of the one or more sheet springs 200 attach to the cam 130 in slots 215. The other end of the one or more sheet springs 200 is in contact with spindle 70. As shown the two or more sheet springs 200 help define the series of shaped channels 210, 220 and 230.

Figure 7:
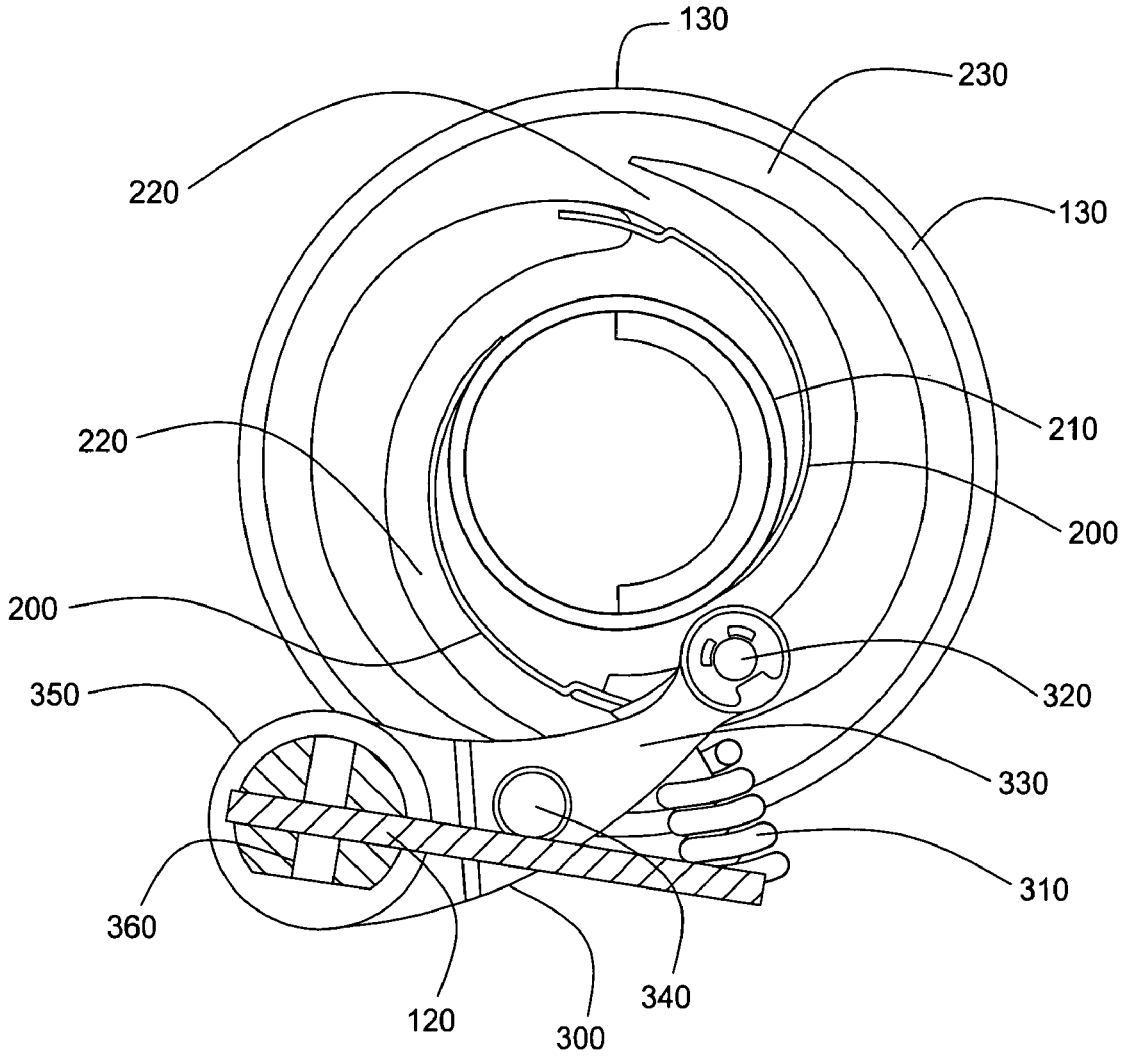
FIG. 7 is an end view of the cam.

FIG. 7 is an end view of the face of the cam 130 showing the cam 130 in engagement with the semi-lever 300. The semi-lever 300 includes a pin 320 which is guided by the cam 130 in the series of channels 210, 220 and 230. The semi-lever attaches to a spring 310 which forces the pin 320 toward the spindle 70. As the cam 130 rotates in a clockwise direction, the pin 320 remains in the interior channel 210 which is the channel closest to the spindle 70. The pin 320 lifts the sheet spring 200 as the pin 320 moves around the spindle 70. As the cam 130 rotates in a counter-clockwise direction, the pin 320 moves away from the spindle 70. The counter-clockwise rotation moves the pin 320 onto the sheet spring 200 and into the channel 220 formed in the middle of the cam 130 and finally to the channel 230 disposed along the outside of the cam 130.

The semi-lever 300 includes a pivot 340, a pin end 330 and a shaft end 350. The shaft end 350 attaches to shaft 360 which attaches to the sheet bar 120. As the pin 320 moves away from the spindle 70, the semi-lever 300 rotates about pivot 340. As the semi-lever 300 rotates, the shaft 360 moves with the shaft end 350. As the shaft 360 moves, the sheet bar 120 is rotated so that the semi-nut 110 becomes disengaged from the threaded portion 80 of the spindle 70.

Figure 8:
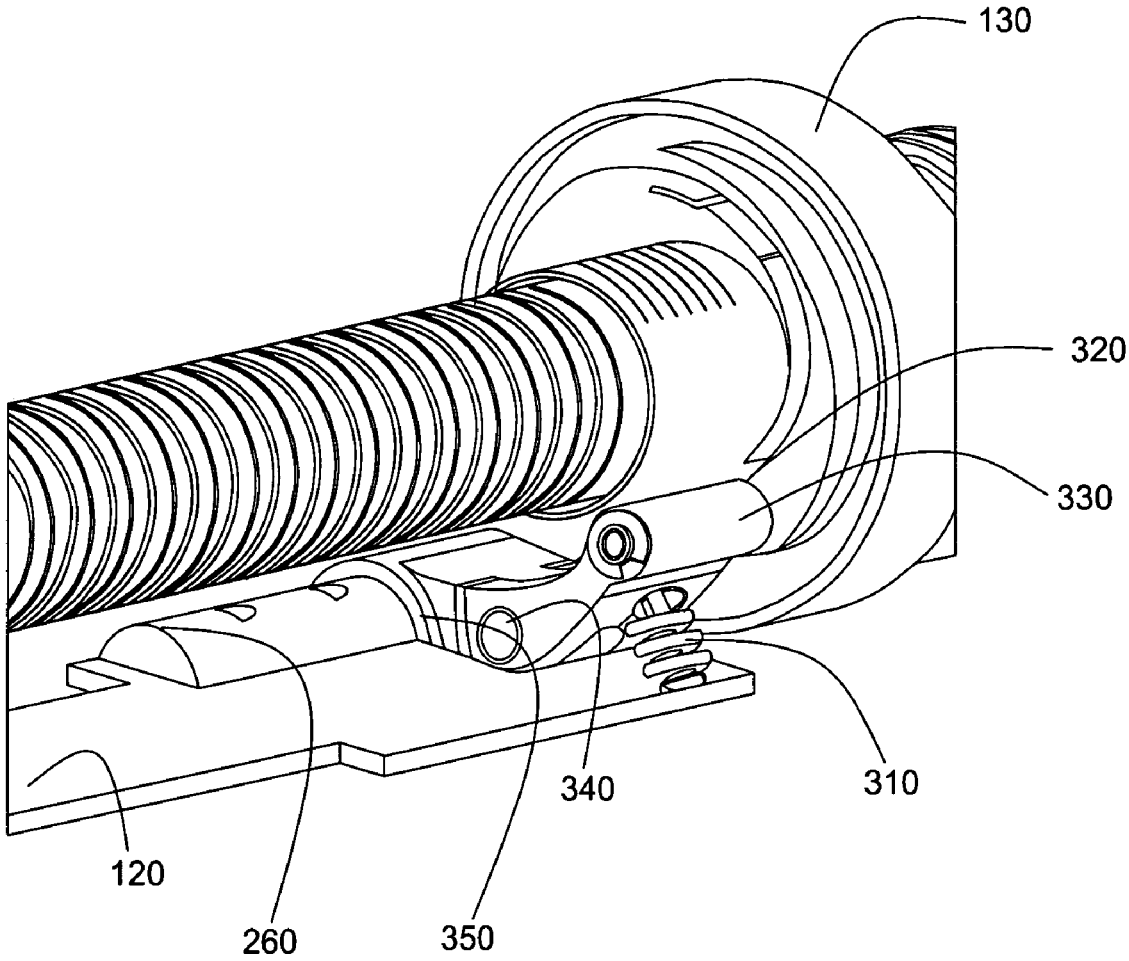
FIG. 8 is a perspective view of the cam and spindle attached to a semi-lever and sheet bar.

FIG. 8 is a perspective view of the cam 130 with the semi-lever 300 and the sheet bar 120 attached. When the spindle 70 moves in a first direction the pin 320 remains next to the spindle 70. With the pin 320 next to the spindle 70, the semi-nut 110 is in engagement with the threaded portion 80 of the spindle 70 because the sheet bar 120 is not acting on the semi-nut 110. Thus, continued rotation in the first direction causes the moveable jaw 10 to move toward the fixed jaw 20 allowing for clamping of a work piece. As the spindle 70 rotates in a second direction, the semi-lever 300 moves the sheet bar 120 so that the semi-nut 110 disengages the threaded portion 80 of the spindle 70. Once disengaged, the semi-nut 110 remains disengaged until the spindle 70 is rotated in the first direction. While the semi-nut 110 is disengaged, a user is able to move the moveable jaw 10 toward and away from the fixed jaw 20 as desired in accordance with the size of the work piece. Once the moveable jaw 10 is in the desired location, the user rotates the spindle 70 in the first direction which moves the pin 320 toward the spindle and in turn the sheet bar 120 rotates to enable the semi-nut 110 to reengage the threaded portion 80 of the spindle. Continued rotation of the spindle 70 in the first direction moves the moveable jaw 10 toward the fixed jaw 20 in order to clamp the work piece.

While the foregoing is directed to embodiments of the present invention, other and further embodiments of the invention may be devised without departing from the basic scope thereof, and the scope thereof is determined by the claims that follow.

The invention claimed is:

1. A clamping apparatus, comprising:

a fixed jaw having a first clamping surface;

a moveable jaw having a second clamping surface;

a spindle engagable to a cam and attached to both the fixed jaw and the moveable jaw for providing movement of the moveable jaw relative to the fixed jaw, the cam rotatable and configured to selectively disengage a semi-nut from the spindle, and wherein the cam includes at least one spiraling groove for leading a pin when the cam is rotated.

2. The apparatus of claim 1, further comprising a bar operated by the cam to move a semi-nut coupled to the fixed jaw between engaged and disengaged positions with respect to a threaded portion of the spindle.

3. The apparatus of claim 2, further comprising a biasing member to urge the semi-nut to the engaged position.

4. The apparatus of claim 3, wherein a clamping force can be applied between the first and second clamping surfaces when the semi-nut is in the engaged position.

5. The apparatus of claim 3, wherein the moveable jaw is freely moveable toward and away from the fixed jaw when the semi-nut is in the disengaged position.

6. The apparatus of claim 5, wherein the semi-nut is capable of remaining in the disengaged position until the spindle is rotated in the first direction once the semi-nut is in the disengaged position.

7. The apparatus of claim 1, further comprising a lever for operating the spindle.

8. A clamping apparatus, comprising:

a base for attaching the apparatus to a surface;

a fixed jaw having a first clamping surface;

a moveable jaw having a second clamping surface; and a spindle coupled to the moveable jaw, the spindle having a cam rotatable therewith and configured to selectively disengage a semi-nut coupled to the fixed jaw from a threaded portion of the spindle, wherein the spindle is rotatable in a first direction to move the moveable jaw toward the fixed jaw due to engagement between the semi-nut and the threaded portion and is rotatable in a second direction to move the semi-nut to a disengaged position with respect to the threaded portion, and wherein the cam contains a series of grooves for manipulating a pin when the cam is rotated, the pin operatively coupled to the semi-nut.

9. The apparatus of claim 8, wherein the series of grooves are arranged to maintain the pin close to the spindle when the spindle is rotated in the first direction.

10. The apparatus of claim 9, wherein the semi-nut is biased into engagement with the threaded portion of the spindle when the pin is close to the spindle.

11. The apparatus of claim 8, wherein the series of grooves are arranged to move the pin away from the spindle when the spindle is rotated in the second direction.

12. The apparatus of claim 11, wherein the semi-nut is movable to the disengaged position in response to movement of the pin away from the spindle.

13. The apparatus of claim 12, wherein the moveable jaw is freely slidable with respect to the fixed jaw when the semi-nut is in the disengaged position.

14. The apparatus of claim 8, wherein the pin is attached to a bar which operates the semi-nut.

15. A method for clamping a work piece, comprising:

rotating a spindle in a first direction, the spindle coupled to a moveable jaw, a fixed jaw, and a cam wherein rotation in the first direction causes the moveable jaw to move toward the fixed jaw;

clamping a work piece between the moveable jaw and the fixed jaw;

rotating the spindle in a second direction;

manipulating a pin in at least one groove in the cam, the pin is operatively coupled to a semi-nut;

disengaging the semi-nut from the spindle to disengage the fixed jaw;

adjusting the moveable jaw to a desired location while the spindle is disengaged from the fixed jaw; and rotating the spindle in the first direction in order to reengage the spindle with the fixed jaw.

16. The method for clamping a work piece of claim 15, further including releasing a portion of a clamping force between the semi-nut and spindle by the initial rotation of the spindle in the second direction.

17. The method for clamping a work piece of claim 16, wherein disengaging the semi-nut is accomplished by pushing the semi-nut down with a bar operatively coupled to the pin.

18. The method for clamping a work piece of claim 17, wherein the semi-nut and spindle disengage upon the clamping force reducing to an amount less that a pushing force created by the bar.

19. A method of clamping a work piece between a moveable jaw and a fixed jaw, comprising:

turning a spindle in a first direction, the spindle attached to a cam with one or more groves for guiding a pin operatively coupled to a semi-nut, the spindle coupled to the fixed jaw and the semi-nut operatively coupled to the moveable jaw to provide motion thereto;

retaining the work piece between the jaws;

releasing a portion of a clamping force between the semi-nut and spindle by an initial turning of the spindle in a second direction;

disengaging the semi-nut from the spindle by continuing to turn the spindle in the second direction.

* * * * *